US005146409A

United States Patent [19]

Atkinson

[11] Patent Number: 5,146,409

[45] Date of Patent: Sep. 8, 1992

[54] MILL ROLL ADJUSTMENT

[76] Inventor: Craig Atkinson, The Beeches, Barlow, Derbyshire S18 5ST, England

[21] Appl. No.: 491,320

[22] Filed: Mar. 8, 1990

[30] Foreign Application Priority Data

Mar. 11, 1989 [GB] United Kingdom ..... 8905608

[51] Int. Cl.[5] ..... G06F 15/46; B21B 31/18

[52] U.S. Cl. ..... 364/472; 72/21; 72/247; 364/571.01

[58] Field of Search ..... 364/167.01, 472, 469, 364/571.01-571.08; 72/8, 9, 21, 237, 238, 239, 247, 248, 249, 226

[56] References Cited

U.S. PATENT DOCUMENTS

| | | | |
|---|---|---|---|
| 4,121,291 | 10/1978 | Hoffner et al. | 364/571.03 |
| 4,154,074 | 5/1979 | Sleurin et al. | 72/21 |
| 4,182,149 | 1/1980 | Wilson | 72/244 |
| 4,471,642 | 9/1984 | Wilson | 72/238 |

*Primary Examiner*—Joseph Ruggiero

*Attorney, Agent, or Firm*—Trexler, Bushnell, Giangiorgi & Blackstone, Ltd.

[57] ABSTRACT

The invention relates to the positioning of rolls to ensure the correct alignment of rolling grooves in the rolls with each other and with the pass line of the product. Hitherto to ensure correct alignment of rolling grooves, repeated trial runs and roll adjustment have been effected until rolling is correct, and when production can recommence. The invention eliminates this problem by predetermining the distances of grooves in a first reference and a second roll from a fixed datum on a base for the roll stand, preferably in a prior calibration stage, which information is stored preferably in a microprocessor, the microprocessor subsequently controlling drive means to move the rolls to align co-operating rolling grooves and align the rolling grooves with the pass line, or to move the second roll with reference to the reference roll to align co-operating rolling grooves, and move roll guides to align the pass line with the rolling grooves.

12 Claims, 5 Drawing Sheets

MILL ROLL ADJUSTMENT

This invention relates to the alignment of rolling mill rolls and in particular to the alignment of rolling grooves in the rolls.

It is quite common in bar or rod rolling mills for each pair of rolls to be provided with more than one co-operating pair of rolling grooves. The second pair of rolling grooves can be identical to the first and such that when the first pair of rolling grooves has worn to an unacceptable degree, the rolls can be adjusted to bring the second pair of grooves into operation. Equally the second or other rolling grooves can be of different sizes, to allow one pair of rolls to roll several product sizes or profiles.

At the point of first manufacture, rolling grooves are produced in the rolls with reasonable accuracy, and there is an expectancy that certainly with a first pair of rolling grooves, the loading of the rolls into the stand or their chocks, and the securing of the stand or the chocks in place, will of itself result in the rolling grooves being aligned with each other and with the pass line of the product to be rolled. However, this cannot be guaranteed, and an adjustment of the position of the stand or chocks to bring a first reference roll, and/or an axial adjustment of the second roll is required to ensure correct alignment of the rolling grooves with each other and with the product pass line.

To bring a second pair of rolling grooves on to the pass line, it is known either to effect lateral movement of the roll-stand of the rolls or the roll chocks such as by a screw-jack system driven by a hydraulic motor, or to effect movement of guides associated with the rolls to move the product pass line to the position of a second pair of rolling grooves. Here again with new rolls, there is no absolute certainty that movement of the stand or the chocks, or guides, will bring the second rolling groove of the reference roll or the second rolling groove of the other roll into their required alignment or the guides into alignment with the second rolling grooves. The positioning of the rolls and hence the rolling grooves is judged by the eye as is the positioning of the guides, sometimes with the aid of the light beam, and once the stand or chocks have been moved to bring the second groove of the reference roll to its required position or to bring the guides to the second rolling grooves, an axial adjustment, effected manually, is frequently required of the second roll to bring its second rolling groove into its required position and of the guides to ensure their correct alignment. Once the rolls and/or guides have been secured, several trial passes of bar or of rod are required and further lateral or axial adjustments made before rolling can commence.

In addition to the above the accurate alignment of the rolling grooves in one stand with the corresponding rolling grooves of the other stands in a multi-stand rolling mill is vital to ensure the production of good product shape and size tolerance.

The problem of correct rolling groove and/or guide alignment is increased when all rolling grooves have worn to an unacceptable degree, and the roll has been subjected to redressing. During rolling, the wear on a rolling groove is not even, and the operative must pay greater attention to the parts of the groove that have been worn to greater degrees. This frequently has the effect of displacing the axial position of the groove on the roll, not necessarily significant on a first dressing of a roll, but which can have an unpredictable accumulated and highly significant effect, resulting from several dressings of a roll. Thus, on relocation of dressed rolls in their stand or chocks, the rolling grooves may not be in alignment with each other or in alignment with the pass line, or in alignment with guides and here again several trial passes of bar or rod are necessary and lateral and axial adjustments of the reference roll and second roll and/or guides effected before rolling can recommence.

The positioning and the repositioning of rolls, particularly dressed rolls and/or guides can take a considerable period of time with consequent lost production, and the object of the present invention is to provide a method of stand setting roll adjustment and/or guide adjustment that avoids the disadvantages mentioned above.

According to a first aspect of the present invention a method of setting the position of rolls for the accurate alignment of co-operating rolling grooves with each other and with the pass line of products to be rolled, comprises establishing a fixed datum point on a base or support plate for the stand or the chocks of the rolls, establishing the distances of the or each rolling groove in each roll from said fixed datum, locating said stand or said chocks on said base in relation to said fixed datum such that a first reference roll has its rolling groove in line with the pass line, effecting any required powered axial adjustment of the second roll in accordance with the predetermined distance as between its first rolling groove and the fixed datum, to ensure alignment of the first rolling groove in the second roll with the first rolling groove in the reference roll, and on repositioning the rolls, a powered movement of the roll stand or chocks is effected to the predetermined required degree to bring a second or subsequent rolling groove of the reference roll into alignment with the product pass line with, a powered axial adjustment of the second roll to bring its co-operating second or subsequent rolling groove into alignment with the second or subsequent groove in the reference roll and the pass line of the product to be rolled, as determined by the pre-established distance of the second or subsequent rolling groove of the second roll from the fixed datum. Preferably, and to save time, the movement of the reference and second rolls is effected simultaneously.

According to a second embodiment of the invention, a method of setting the position of rolls for the accurate alignment of co-operating rolling grooves with each other and with the pass line of products to be rolled, comprises establishing a fixed datum point on a base or support plate for the stand or the chocks of the rolls, establishing the distances of the or each rolling groove in each roll from said fixed datum, locating said stand or said chocks on said base in relation to said fixed datum such that a first reference roll has its first rolling groove in line with the pass line, effecting any required powered axial adjustment of the second roll in accordance with the predetermined distance as between its first rolling groove and the fixed datum, to ensure alignment of the first rolling groove in the second roll with the first rolling groove in the reference roll, effecting a powered axial adjustment of roll guides associated with rolls, with reference to the fixed datum to ensure alignment of the roll guides with the product pass line and with the first rolling grooves, and on a repositioning of the roll guides, a powered movement of the roll guides is effected to a predetermined degree with reference to the datum to bring the product pass line into alignment with a second or subsequent pair of rolling grooves with any required adjustment of the second roll in relation to the reference roll, to ensure alignment of the second or subsequent rolling groove in the second roll with its co-operating second or subsequent rolling groove in the reference roll and with the product pass line, as determined by the pre-established distance of the guides and the second or subsequent rolling groove of the second roll from the fixed datum.

The method of the invention lends itself particularly well to microprocessor control. Thus, at the first building of a new mill stand, the required positions of the roll stand or chocks and/or roll guides in relation to a fixed datum on the base plate to ensure that a first pair of rolling grooves are in alignment and/or roll guides can be loaded in the microprocessor, as can the distances of second and subsequent rolling grooves in each roll. Following assembly, the microprocessor can control appropriate drive means for both the stand or chocks, or guides, and for axial adjustment of the second roll, to locate them accurately in their first position. When a first pair of grooves has worn or when a second product is to be rolled, the microprocessor can signal both the stand/chocks drive means of the reference roll and the stand/chocks drive means for the second roll to move the rolls precisely to the required degrees to bring a second or subsequent groove of the reference roll into alignment with the pass line and the second or subsequent rolling groove into alignment with the second rolling groove on the reference roll, or in the alternative can ensure that the second rolling groove in the second roll is in alignment with the second rolling groove in the reference roll, and bring the roll guides and hence the product pass line into exact register with the aligned second rolling grooves.

When a redressed roll is located in its stand or chocks, and where the centre lines of its rolling grooves may have been displaced, the distances of the redressed rolling groove centres from the fixed datum can readily be re-established, and when the information in the microprocessor can be amended. Thus at the commencement of rolling with a redressed roll, there is the certainty of alignment of the first rolling grooves and/or the roll guides, and when repositioning is required, the certainty of correct alignment of second and subsequent pairs of rolling grooves and/or roll guides.

It is ordinarily the case that when guides are provided both infeed and outfeed guides are associated with the rolls, they need to be moved to bring them clear of the rolls, and to allow repositioning of the rolls. Here again there is the need for correct repositioning of both the infeed and outfeed guides when they are repositioned, or correct alignment of different guides when roll adjustment is for the purpose of rolling a different product. It is therefore a further advantage of the invention that power means for both infeed and outfeed guide movement and repositioning can be under the control of the microprocessor. Thus, when roll repositioning is required, the microprocessor first signals movement of the infeed and outfeed guides to bring them clear of the rolls, then signals the required movement of the roll stand and rolls or chocks and rolls and finally signals the return of the guides, with the certainty that the guide centres are on the product pass line. Equally certain, when the guides are moved to take the product pass line to a second pair of rolling grooves is the alignment of the infeed and outfeed guides with the second pair of rolling grooves.

Conventional practice is such that during rolling with a first pair of grooves, progressive wear requires a progressive closing of the roll gap to maintain product size. When a second pair of grooves is brought into operation, the rolls must be returned to the original roll gap setting. Here again, microprocessor control is well suited to control both operations efficiently and quickly.

It will be appreciated that particularly with the aid of microprocessor control, the time required between the cessation of rolling and the recommencement of rolling with the rolls repositioned, is considerably reduced in comparison with existing techniques, with a consequent considerable improvement in productivity.

To enable the accurate derivation of the positions of the dead centres of the rolling grooves, it is preferred to have a calibration stage at the point of first manufacture or at the point of redressing the rolls, the reference and second rolls may be located in a frame on which a datum is provided at exactly the same distance from the roll edge, as is the distance of the datum on the base plate from the roll edge with the roll installed. The distance of the bottom dead centre from the datum of each groove is then carefully measured and that information entered into a microprocessor, and the exercise repeated on the second roll, along with the distance from the datum on the stand base to the product pass line.

Thus, with the first aspect of the invention, and with the rolls located in their stands or chocks, the stands/chocks and the reference roll can be moved under the control of the microprocessor activating an appropriate power source, such as for example, a hydraulic ram, to place the roll in relation to the datum on the base, identically to the distance determined at the calibration stage as between the first rolling groove dead centre and the datum on the framework, and as that datum is positioned at a predermined distance from the product pass line, the first rolling groove of the reference roll is then automatically and accurately positioned to be in alignment with the pass line. Separately or simultaneously, the microprocessor signals drive means for stands or chocks of the second roll to bring it to a first position where the dead centre of its first groove is the same distance from the datum on the base plate, as has previously been determined as its distance from the datum on the framework at calibration, and when there is the certainty that the first rolling grooves of the reference and second rolls are in exact alignment with each other and with the product pass line. When any second or subsequent pair of rolling grooves are to be used, the drive means for the stands or chocks of the reference roll and the second roll are again driven under the control of the microprocessor to bring the dead centre of the second groove in the reference roll and the dead centre of the second groove in the second roll each to their predetermined distances from the datum, with the certainty that the second rolling grooves are in alignment with each other and with the passline of the product.

With the second aspect of the invention, calibration as discussed above is effected, but the reference roll is positioned in its chocks or stand and which are located on the base to put the first rolling groove at the required distance from the datum and such that it is aligned with the pass line of the product, the microprocessor then signalling and controlling drive means for the second roll to move it to the degree required to put its first rolling groove at the predetermined distance from datum to ensure alignment with the first rolling groove of the reference roll. The microprocessor also activates and controls drive means, such as for example a hydraulic ram, for infeed and for outfeed guides and to position them in relation to the datum whereby the product passline is in alignment with the first rolling grooves. When second rolling grooves are required to be used, the microprocessor signals the drive means of the second roll to cause movement of the second roll in accordance with the predetermined distances of the dead centres of the second rolling grooves in the reference and second rolls from the datum and whereby the second rolling groove in the second roll is brought into exact alignment with the second roll in the reference roll. Subsequently or simultaneously, the microprocessor signals the drive means for the infeed and outfeed guides to move them by the predetermined distance of the second groove in the reference roll from the datum, and when the bringing of the pass line of the products into alignment with the aligned second rolling grooves is guaranteed.

To enable calibration to take place, it is preferred to provide a scanning unit that may be a line scan camera, a laser or number of lasers, an optical viewer or a telescope, on a laterally movable table mounted in front of the framework for the rolls, the table being mounted on a support, to be parallel to top and bottom of the rolls in the frame. A fixed stop is located on the support to be contacted directly or indirectly by the table, and the scanning unit secured to the table at a predetermined distance along the table to locate the scanning unit initially in line with the edge of the rolls. Subsequent movement of the table carries the scanning unit across the roll to "read" the position of the rolling grooves and from the readings taken the position of the dead centre of the grooves can readily be determined, and hence the distances of the groove dead centres from the datum.

The invention will now be described by way of example only, with reference to the accompanying schematic drawings, in which FIGS. 1 and 2 are respectively front and side elevations reflecting the calibration stage of the invention;

Figure 1:
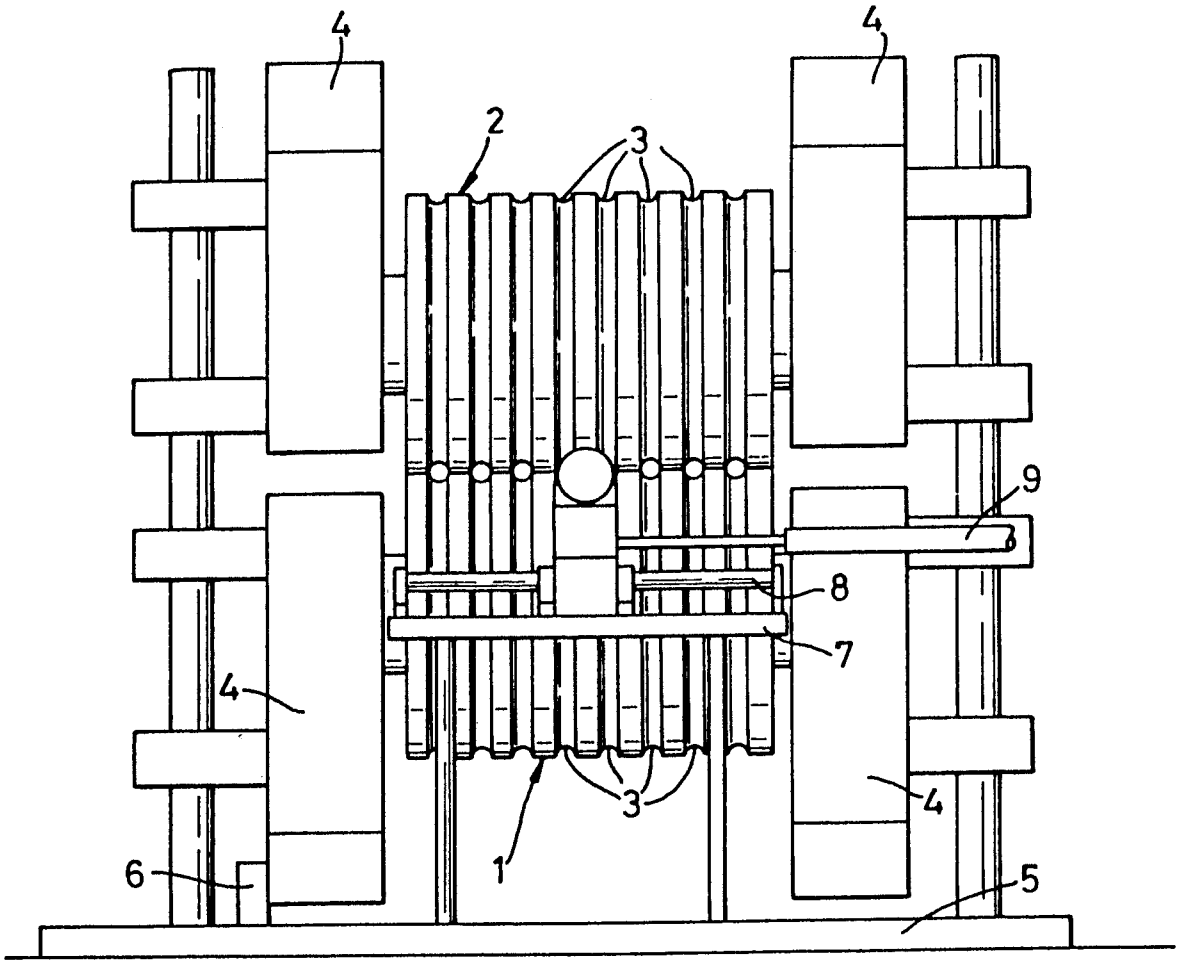
Figure 2:
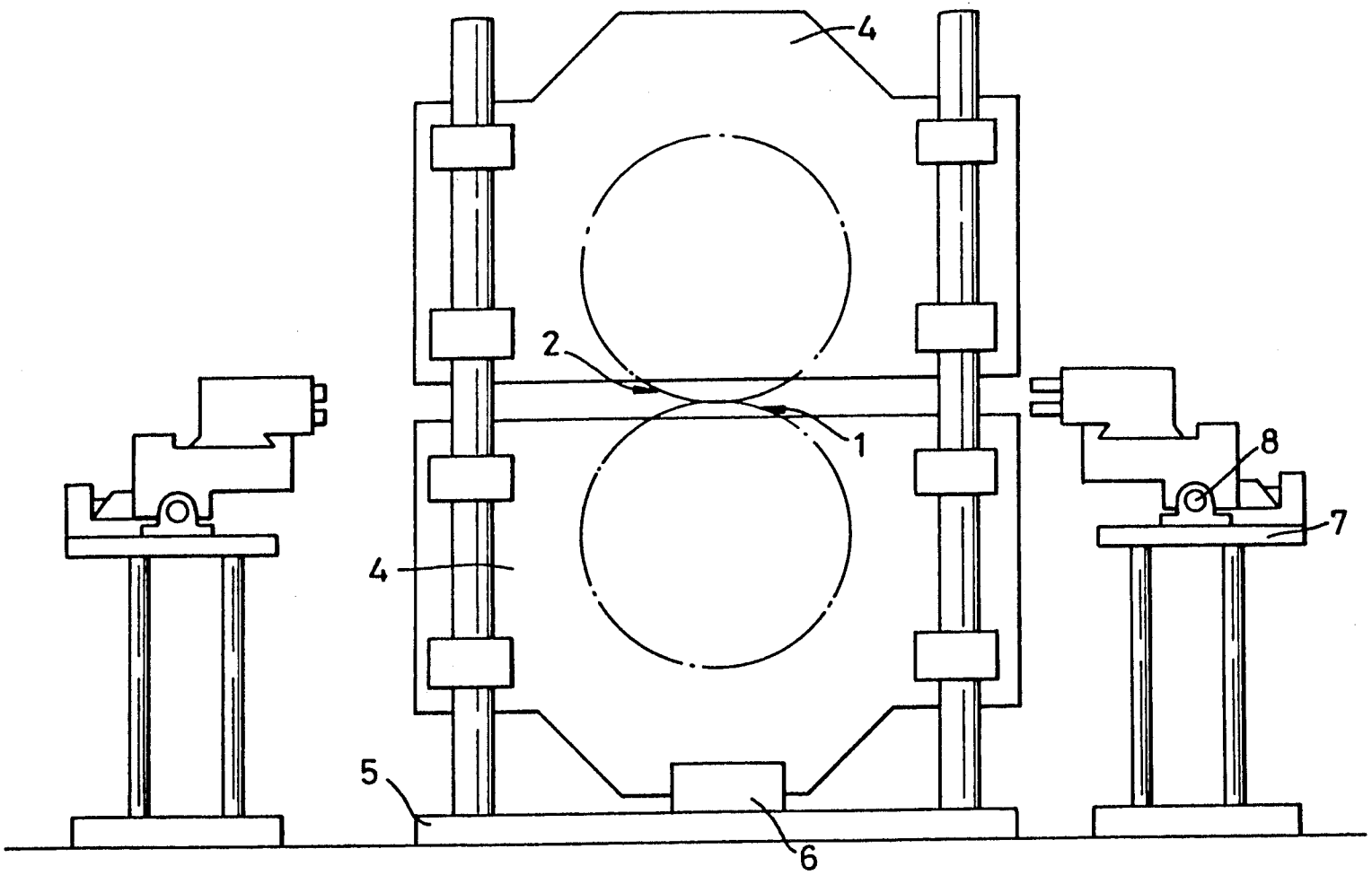

In FIG. 1, a reference roll 1 and a second roll 2 in each of which a number of co-operating rolling grooves 3 have been formed, are located in frame members 4, the frame members 4 being secured to a base 5 on which a datum 6 is provided to position the frame members and hence the rolls at a preset distance from the datum. In front of the frame, a horizontal table 7 is provided on which a line scan camera is mounted by way of a vernier screw 8 to allow lateral movement of the line scan camera. Attached to the line scan camera is a linear transducer 9. Thus, with the line scan camera set at one end position and at a known distance from the datum, and with information relating to that known distance provided to a microprocessor, the line scan camera is progressed across the table in tandem with a light source, to the opposite side of the rolls. Preferably two laser light sources are provided, and two scanning heads provided on the camera to determine separately the positions of the rolling grooves in the reference and second rolls. As the laser beams traverse respective grooves, several readings of groove side position are taken along with a respective position indicated by the linear transducer, and the information encoded and passed to the microprocessor where it is evaluated, and the distance dead centres of the grooves calculated, which together with the predetermined distance of the rolls from the datum, establishes any difference between the dead centre of a groove in the reference roll and the dead centre of the co-operating roll in the second roll.

Figure 3:
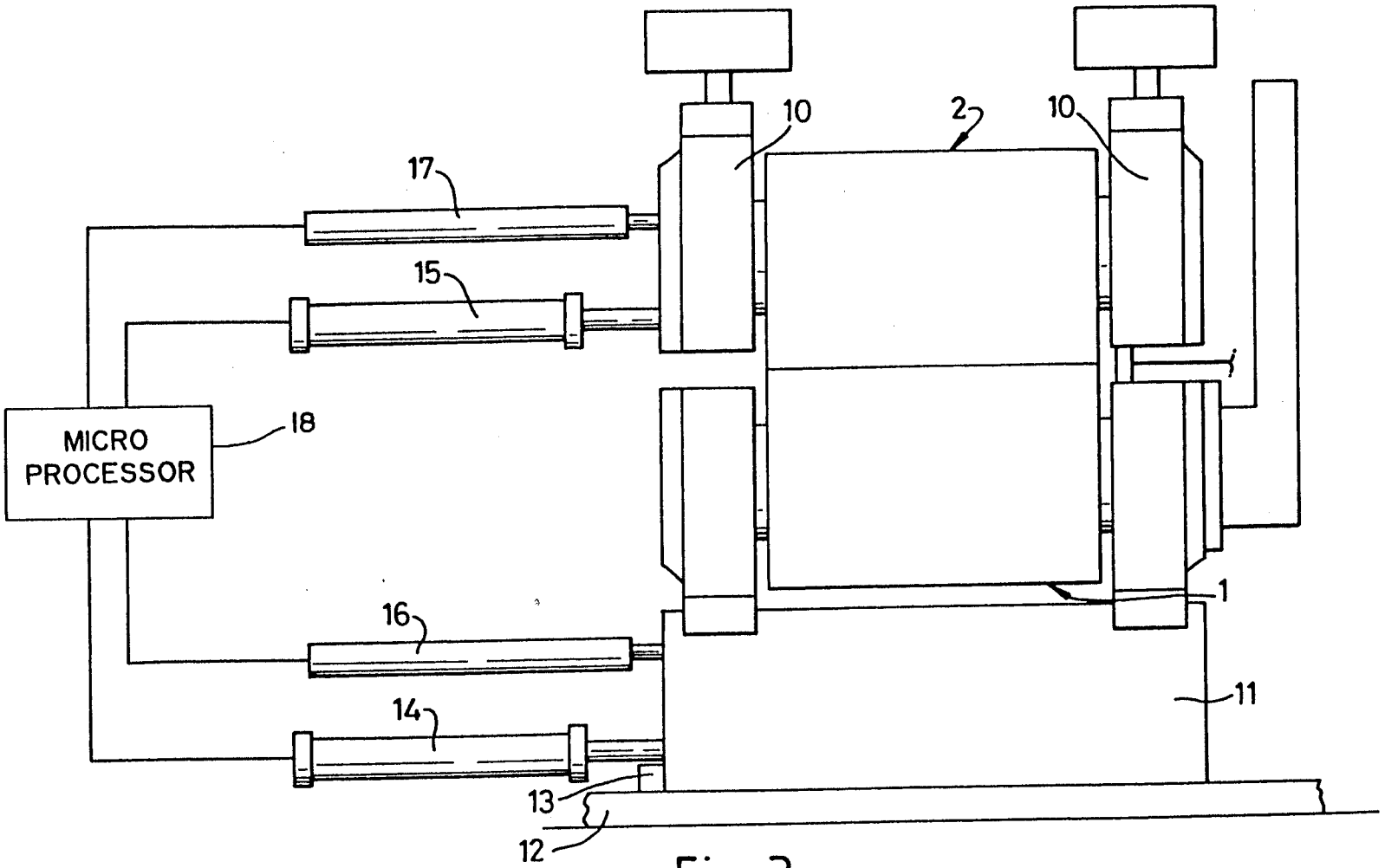
FIG. 3 is a schematic front elevation of a roll stand adapted for roll adjustment in accordance with the invention.

With this information stored in the microprocessor, the reference and second rolls are taken to their point of use and, as is schematically indicated in FIG. 3 secured in chocks 10 of a roll stand, and on an upper movable base plate 11 mounted on a lower fixed base plate 12. On the fixed base plate 12 is a datum 13, and hydraulic drive means 14 and 15 respectively are provided for the chocks of the reference and second rolls respectively. Also provided are linear transducers 16, 17 respectively attached to the chocks of the reference and second rolls. The hydraulic drive means and the transducers are connected to the microprocessor 18 in which the relevant control information is stored.

Thus, with the movable base so located as to abut the datum, the position of a first rolling groove in the reference roll is known to be co-incident with the product pass line. With the second roll initially mounted in the mill in relation to the reference roll identically to their respective positions in the frame at calibration, any deviation of the dead centre of the first rolling groove in the second roll from the dead centre of the rolling groove in the reference roll is corrected by the microprocessor signalling the hydraulic drive 15 to move the second roll by the required degree and which when sensed by the linear transducer ends the movement of the second roll. The chocks can then be locked and rolling commenced in the certainty that the roll grooves are in alignment with each other and with the product pass line. When a second pair of rolling grooves are required to be used the chocks are unlocked, and the microprocessor signals the activation of the hydraulic drives 14 and 15 to move both the reference roll and the second roll, and when the linear transducers have sensed that each roll has been moved by the respective predetermined distances of their respective dead centres from the datum, the drives are deactivated and the chocks re-locked ready to recommence rolling in the certainty that the second rolling grooves are in alignment with each other and with the product pass line.

Figure 4:
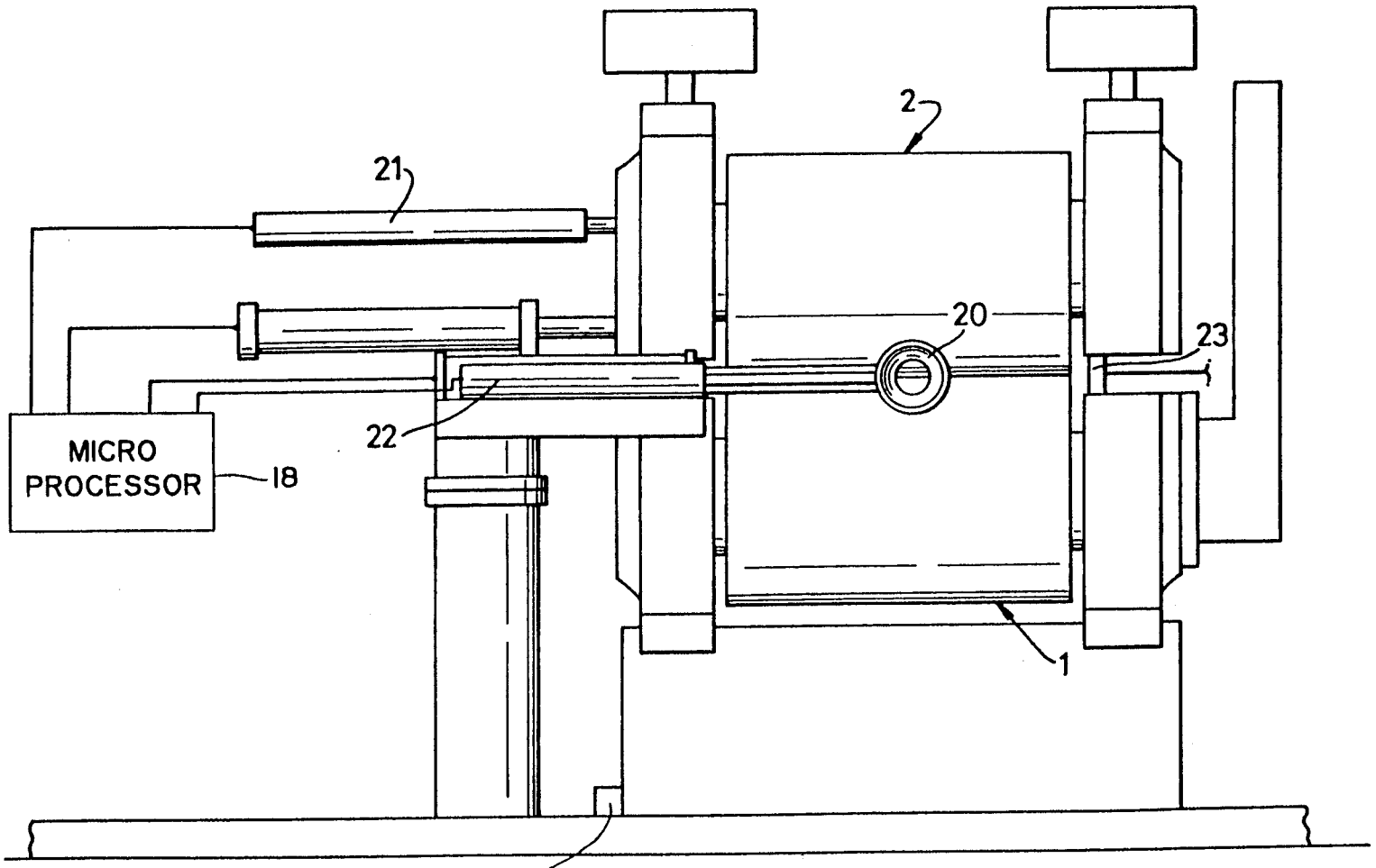
FIG. 4 is a schematic front elevation of a roll stand adapted for second roll and guide adjustment in accordance with the invention.
Figure 5:
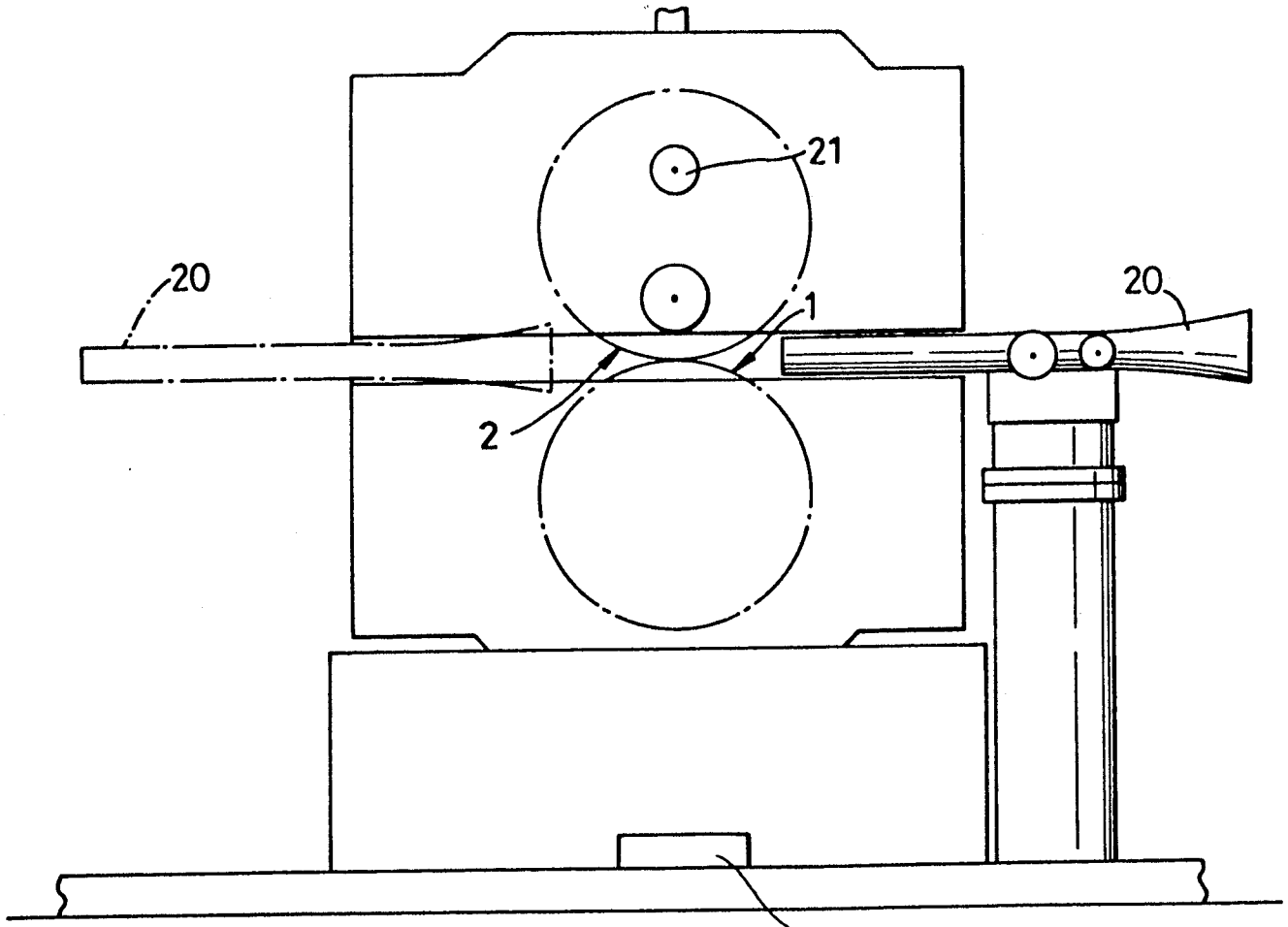
FIG. 5 is a schematic side elevation of FIG. 4.

In the alternative type of rolling mill indicated in FIG. 4, here it is the case that the reference roll and second roll are mounted in stands in fixed relationship to the base, with the second roll adjustably mounted in relation to the fixed base. The stands are mounted on the base in abutment with a datum 19, and the reference and second rolls subjected to the same calibration stage as has previously been described. Here and as is shown more particularly in FIG. 5, product guides 20 are provided, slidably mounted across the line of the rolls by, e.g. a hydraulic drive, and there being linear transducers 21 and 22 respectively attached to the second roll and the product guides. Thus with the linear transducers and hydraulic drives connected to the microprocessor 18, the second roll can be unclamped and adjusted to any degree previously determined at calibration to put the dead centre of the first rolling groove of the second roll into alignment with the dead centre of the first rolling groove in the reference roll.

When the linear transducer 21 has sensed that the required degree of movement has been effected, the drive to the second roll is deactivated and the second roll locked ready for rolling in the certainty that the rolling grooves are in alignment. In addition the hydraulic drive to the roll guides is activated to put the roll guides in a first position, at the distance from the datum as is the dead centre of the rolling groove in the reference roll, and when the linear sensor has sensed that degree of movement the drive to the guides is deactivated, and the guides locked in position, in the certainty that the product pass line through the guides is in exact alignment with the first rolling grooves.

When any second pair of rolling grooves are to be used, the second roll and guides are unclamped, the second roll adjusted under the control of the processor and its linear transducer to put the rolling grooves into alignment, and the guides moved by the required degree in relation to the datum to put the product pass line in exact alignment with the second rolling grooves. The second roll and guides are then reclamped ready for rolling.

During rolling and with wear taking place of the rolls and particularly the rolling grooves, the roll gap needs to be monitored and adjusted. Here again, information relating to roll gap can be stored in the microprocessor and a linear transducer 23 provided to sense movement of reference and second rolls towards or away from each other. At the point of installation of new rolls, the microprocessor can control appropriate drive means to set the roll gap to the required distance, and an ajustment from that during use sensed by the linear transducer and loaded into the processor. When further new rolls or redressed rolls are located in the stand or chocks, the microprocessor signals drive means to the rolls to reset them at the required distance, and when the linear transducer senses that the required degree of movement has been completed, the drive is deactivated.

It will be understood that several varied forms of rolling mill can be subjected to the calibration and roll adjustment of the invention, and with the rolling mill stands and chocks and with a movement permitted between the stands/chocks and base and between the rolls of relatively conventional construction.

I claim:

1. A method of setting the position of rolls for the accurate alignment of co-operating rolling grooves with each other and with the pass line of products to be rolled characterised by establishing a fixed datum point (13) on a base or support plate (12) for the stand or the chocks (10) of the rolls (1, 2), establishing the distance of a first rolling groove (3) in each roll from said fixed datum, locating said stand or said chocks (10) on said base (12) in relation to said fixed datum (13) such that a first reference roll (1) has its rolling groove (3) in line with the pass line, effecting any required powered axial adjustment of the second roll (2) in accordance with the predetermined distance as between its first rolling groove (3) and the fixed datum (13), to ensure alignment of the first rolling groove in the second roll with the first rolling groove in the reference roll, and to reposition the rolls, effecting a powered movement of the roll stand or chocks to the predetermined required degree to bring a further rolling groove of the reference roll into alignment with the product pass line with, and effecting a powered axial adjustment of the second roll to bring its co-operating further rolling groove into alignment with the second or subsequent groove in the reference roll and the pass line of the product to be rolled, as determined by the pre-established distance of the further rolling groove of the second roll from the fixed datum.

2. A method as in claim 1, characterised by effecting a simultaneous movement of the reference and second rolls (1, 2).

3. A method of setting the position of rolls (1, 2) for the accurate alignment of co-operating rolling grooves (3) with each other and with the pass line of products to be rolled characterised by establishing a fixed datum point (19) on a base or support plate (12) for the stand or the chocks (10) of the rolls, establishing the distances of the or each rolling groove (3) in each roll (1, 2) from said fixed datum (19), locating said stand or said chocks (10) on said base (12) in relation to said fixed datum (19) such that a first reference roll (1) has its first rolling groove (3) in line with the pass line, effecting any required powered axial adjustment of the second roll (2) in accordance with the predetermined distance as between its first rolling groove (3) and the fixed datum (19), to ensure alignment of the first rolling groove (3) in the second roll (2) with the first rolling groove (3) in the reference roll (1), effecting a powered axial adjustment of roll guides (20) associated with rolls (1, 2), with reference to the fixed datum (19) to ensure alignment of the roll guides (20) with the product pass line and with the first rolling grooves (3), and to reposition the roll guides (20), effecting a powered movement of the roll guides (20) to a predetermined degree with reference to the datum (19) to bring the product pass line into alignment with a further pair of rolling grooves (3), and effecting any required adjustment of the second roll (2) in relation to the reference roll (1), to ensure alignment of the second or subsequent rolling groove (3) in the second roll (2) with its co-operating second or subsequent rolling groove (3) in the reference roll (1) and with the product pass line, as determined by the pre-established distance of the guides (20) and the second or subsequent rolling groove (3) of the second roll (2) from the fixed datum (19).

4. A method as in claim 1, characterised by entering into a microprocessor the established distances of the fixed datum (13, 19) to the product pass line and the established distances from the datum (13, 19) to the rolling grooves (3) in the reference and in the second rolls (1, 2) said microprocessor controlling appropriate drive means (14, 15) for axial adjustment of the rolls (1, 2) and/or roll guides (20) in accordance with the established distances stored in the microprocessor (18).

5. A method as in claim 1, characterised by re-establishing the distances of the centre lines of redressed rolling grooves of a reference and/or a second roll (1, 2), and entering said re-established distances of the centre lines of the redressed rolling grooves (3) in the microprocessor (10) in place of the original centre line to datum distances.

6. A method as in claim 1, characterised by sensing the degree of linear movement associated with the rolls (1, 2) and/or the roll guides (3).

7. A method as in claim 3, characterised by initially positioning infeed and outfeed roll guides (20) in accordance with the established distance of a first pair of rolling grooves (3) from the datum (13, 19), and each subjected to a subsequent powered movement to reposition them by a predetermined degree to align both the infeed and outfeed roll guides (20) with a second pair of rolling grooves (3).

8. A method as in claim 4, characterised in that the reference and second rolls are adjustable in a plane perpendicular to their axes to adjust the roll gap between them, and to provide a predetermined roll gap, said predetermined roll gap being stored in a microprocessor, and said microprocessor providing control over drive means to adjust said rolls.

9. A method as in claim 1, characterised by establishing in a calibration stage the distances from the datum (13, 19) to the rolling groove centre lines following the first production of new rolls or following redressing of rolling grooves in existing rolls.

10. A method as in claim 9, characterised by first locating reference and second rolls (1, 2) in a frame (4) on which a datum (6) is provided at exactly the same distance from the roll edge, as is the distance of the datum (13, 19) on the base plate (12) from the roll edge with the roll (1, 2) installed, and scanning parallel to and across the rolls.

11. A method as in claim 10, characterised by mounting a scanning unit (7, 8) on a table (7) itself mounted on a support, and there being a fixed stop on the support for contact by the table, locating the table (7) on the support for the scanning unit (7, 8) to be in-line with the edges of the rolls, and moving the table and hence the scanning unit across the rolls to determine the distance of each rolling groove (3) from the roll edge and hence each rolling groove from the fixed datum (6) on the frame (4) for the rolls.

12. A method as in claim 10 or claim 11, characterised by traversing a light source across the rolls in tandem with said scanning.

* * * * *